United States Patent [19]

Fisher

[11] Patent Number: 4,548,342

[45] Date of Patent: Oct. 22, 1985

[54] FLOW CONTROL INSERT FOR HOPPER BOTTOM BINS

[75] Inventor: Glen W. Fisher, Bellevue, Wash.

[73] Assignee: Technovators, Inc., Seattle, Wash.

[21] Appl. No.: 483,656

[22] Filed: Apr. 11, 1983

[51] Int. Cl.[4] ..... B65D 88/28

[52] U.S. Cl. ..... 222/145; 222/185; 222/564

[58] Field of Search ..... 222/145, 185, 502, 564; 366/101, 341; 414/288, 293

[56] References Cited

U.S. PATENT DOCUMENTS

| | | | |
|---|---|---|---|
| 1,224,656 | 5/1917 | McCandliss | 366/9 |
| 1,415,830 | 5/1922 | Fredel et al. | 366/336 |
| 2,412,135 | 12/1946 | Evans | 208/171 |
| 2,783,898 | 3/1957 | Ardern et al. | 214/17 |
| 2,843,274 | 7/1958 | Williams | 214/17 |
| 2,994,460 | 8/1961 | Matthews | 222/145 |
| 3,423,076 | 1/1969 | Jacobs et al. | 259/180 |
| 3,575,321 | 4/1971 | Fisher | 222/145 |
| 3,583,681 | 6/1971 | Brown | 259/36 |
| 4,030,633 | 6/1977 | Fisher | 222/1 |
| 4,159,881 | 7/1979 | Gogneau | 366/337 |
| 4,286,883 | 9/1981 | Johanson | 366/137 |

FOREIGN PATENT DOCUMENTS 2812092 10/1979 Fed. Rep. of Germany .

OTHER PUBLICATIONS

Technovators, Inc., Seattle, WA (Product Information Sheet) "Time Controlled Bulk FiFo Bin IFI System".

*Primary Examiner*—F. J. Bartuska
*Assistant Examiner*—Louise S. Heim
*Attorney, Agent, or Firm*—Dowrey & Cross

[57] ABSTRACT

Solid particulate material is moved through a hopper bottom bin in mass flow inducted by a conical surface positioned within the hopper to compensate for the shallowness thereof. Laminar mass flow movement will occur in the uppermost region of the material within the vertical bin walls. The hopper cross-section is separated into segregated flow channels by the conical surface, and by webs extending therefrom. The conical surface and webs have overall dimensions small enough for insertion through a bolt ring on the bottom of the hopper. The proportion of the material flowing through each channel is chosen to achieve a desired discharge flow pattern by varying the relative cross-sectional areas of either the inlets or the outlets of the channels. This results in changes in the velocity profile of the downwardly flowing material in a zone above and adjacent to the separate flow channels.

17 Claims, 5 Drawing Figures

FLOW CONTROL INSERT FOR HOPPER BOTTOM BINS

FIELD OF THE INVENTION

This invention relates to methods and apparatus for controlling the flow of particulate, granular or other flowable solid materials. More particularly, it relates to a method and apparatus for controlling the flow patterns of such materials within hopper bottom bins.

BACKGROUND OF THE INVENTION

The typical hopper bottom bin for flowable bulk solid materials, such as grain, metal ores, or plastic pellets, has a vertical cylindrical section joined at its lower edge to a conical or frustro-conical hopper. The bin is filled through an inlet opening at the top of the cylindrical section, and is emptied through an outlet at the lowermost point of the hopper. Discharge apparatus for guiding the material from the bin to its destination or starting and stopping the discharge flow is commonly bolted or welded to a bolt ring mounted around the outer surface of the hopper at its bottom.

Although the above-described configuration is typical, the geometry of bins varies. For example, the inlet opening may be centered over the bin, or positioned to one side of the bin roof or on a side wall of the bin. The hopper may be a right circular cone with a centered outlet, or a cone having an oblique axis and an outlet which does not lie along the central axis of the bin. Other variations, for example in the cross-sectional shape of the bin, are also found.

A problem occuring in nearly all bins, despite these variations, is the segregation of material according to particle size, shape or density as it is introduced into a bin. Material deposited in a bin generally forms a conical pile centered under the inlet opening, with coarse particles tending to roll outward and down to the periphery of the bin and fine particles tending to accumulate in the center. This results in segregation of different sized particles in different regions within the bin.

Another problem common to many bins is a tendency for segregation of material to become enhanced as the material is discharged from the bin. This is a result of funnel flow, where material directly above the discharge outlet moves downward at a greater speed than material elsewhere, while material in some regions of the bin may not move at all. If the outlet is located directly under the inlet, the fine particles which tend to accumulate directly under the inlet will be discharged before the coarser ones, resulting in more pronounced segregation. If the outlet is elsewhere, the coarser particles will be discharged first, and a more pronounced segregation will still result.

A further undesirable effect of funnel flow is that it causes layers of material deposited at successive time intervals to intermix in an uncontrolled manner. In some circumstances, it is desirable to have material exit a bin in the same order that it entered; in other situations, it may be desirable for material from successive layers to be blended together as the bin is emptied. Adequate control of the extent of the intermixing of layers, either to prevent or to promote their blending, is not provided by the structure of most bins.

In contrast to funnel flow, where some material in a bin moves downward while a portion remains stationary, "mass flow" is a name given to a condition where all material in the bin moves simultaneously, and none stands still. "Laminar mass flow" designates a special case of mass flow, where all material moves in the same direction at the same speed, and no cross-movement of material occurs. Thus, all particles of material remain at the same position relative to each other, within a mass which moves downward as a unit.

Prior art devices developed in an attempt to control segregation and blending of material have been costly to manufacture and install. For example, a multiple-opening bin bottom made up of multiple adjacent hoppers has been proposed to provide laminar mass flow in a bin for the withdrawal of material in the order of its entry into the bin. But, the complicated design of this apparatus makes its fabrication expensive. Furthermore, such an apparatus cannot be retrofitted to an existing bin without a costly restructuring of the bin bottom.

Another device designed to provide laminar flow of material and minimize enhancement of segregation during its discharge includes a large cone positioned within a hopper and extending from the bottom to the top of the hopper. Vanes mounted on the cone extend out to the hopper walls. Because the device is shipped in completed form, with the cone and vanes mounted in a hopper at the factory, the device is cumbersome and difficult to ship. Furthermore, this device requires large amounts of material for its manufacture.

A blending apparatus disclosed in U.S. Pat. No. 4,286,883 to Johanson includes a conical insert to promote mass flow movement of material in a self-emptying hopper. A complicated and bulky structure to suspend the cone within the bin and a special hopper design are required, making this apparatus expensive to manufacture, and difficult to scale up to larger bins.

Thus, the bulk materials handling art has long needed a system which can achieve or exceed the flow control provided by prior art devices, while being easily retrofitted to a variety of existing hopper bottom bins, and selectively fine tuned to achieve the desired flow within a particular bin. Ideally, such a device would be inexpensive to manufacture and ship, and would be installed with little or no on-site alteration of pre-existing bin structure being necessary.

BRIEF DESCRIPTION OF THE INVENTION

The present invention provides a method and a device for controlling the flow of particulate solid material through a hopper bottom bin. In the system of the present invention, material is moved through the bin in mass flow. An inner tapered surface which is sufficiently steep to promote this mass flow movement extends through the opening at the bottom of the hopper, and is supported in its operable position by webs which extend down to an outer tapered surface mounted to the hopper adjacent and below its opening. The inner tapered surface compensates for the shallowness of the hopper, and provides mass flow within the hopper which otherwise would not mass flow. By developing mass flow within the several zones of the bottom, laminar mass flow movement of material in the uppermost region of the bin down to within a short distance above the hopper is provided.

The webs and outer tapered surface, in addition to supporting the inner tapered surface, also define peripheral channels below the hopper which are segmented extensions of the annular channel between the hopper and the inner tapered surface. The proportions of the material flowing through each of these channels is chosen so that the desired discharge flow pattern is achieved. These proportions can be set by varying the relative cross-sectional areas of either the inlets or the outlets of the channels. This results in changes in the velocity profile of the downwardly flowing material in a zone below and adjacent to the laminar mass flow region. The choice of proportions of material flowing through each separate channel makes possible the selective control of the flow pattern of the material. For example, if a faster average flow on one side of a bin is desirable because the bin inlet is located over that side of the bin, the area of hopper inlets on that side can be decreased, or the area of hopper outlets on that side increased, to allow a greater rate of flow therethrough.

Below the separate channels, stream combining means are provided to blend the material from the channels into a single stream in a laminar mass flow zone.

The horizontal cross sections of the inner and outer tapered surfaces are similar to that of the hopper, and the inner and outer surfaces are generally coaxial with the hopper. In a circular conical hopper, for example, these surfaces will be circular cones. The outer dimension of the inner tapered surface and webs is sufficiently small for the device to be installed by insertion up through the opening at the bottom of the hopper. The webs are generally triangular, with one side mounted to each of the two tapered surfaces. The third side of each triangular web is a vertical edge, resulting in a compact design which is insertable through the opening of the hopper, easily transported, and manufactured with a minimum of material.

The invention is well suited for circular bins having right conical hoppers, but can be modified for use with bins and hoppers of non-circular cross sections, and hoppers having oblique axes and off-center discharge outlets.

DETAILED DESCRIPTION OF THE PREFERRED EMBODIMENTS

Figure 1:
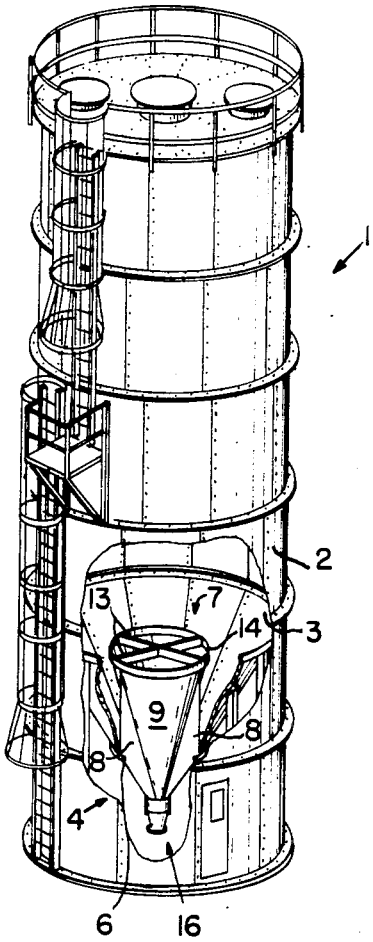
FIG. 1 is a partially broken away view of a storage bin with a preferred embodiment of the flow control device of the present invention in place.
Figure 2:
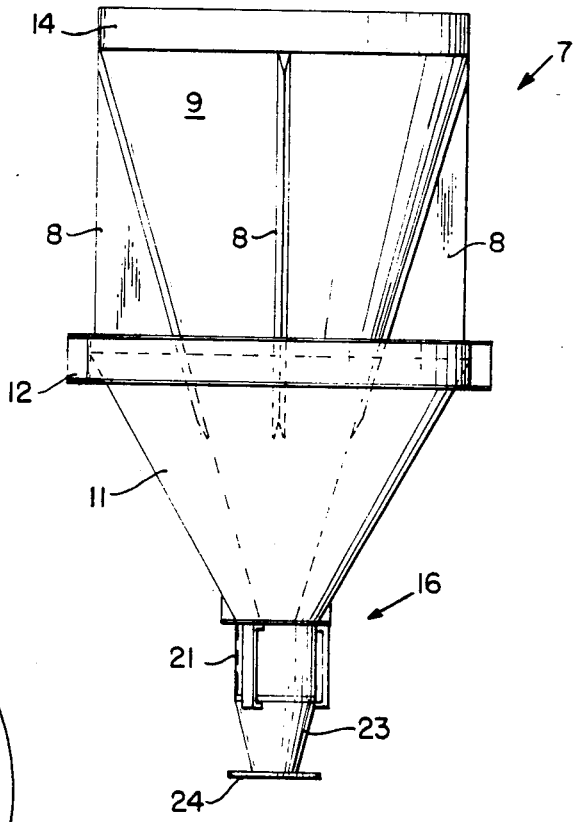
FIG. 2 is a side view of the device of FIG. 1.
Figure 3:
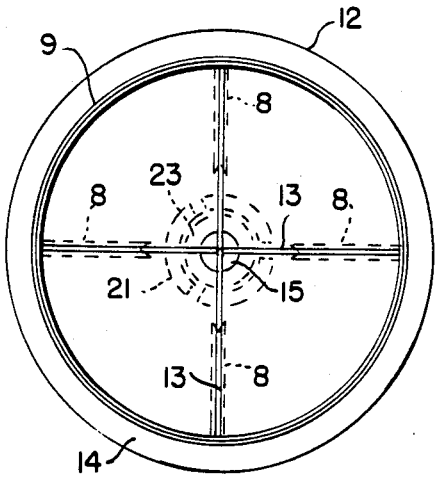
FIG. 3 is a top view of the device of FIG. 1.

Although the present invention can be used with bins of various configurations, it will be explained for illustrative purposes in connection with the common cylindrical hopper bottom bin with a central discharge outlet.

Referring to FIGS. 1–4, a vertical bin 1 for paticulate or granular solids such as grain, flour, metal ores, chemical or plastic pellets, has a cylindrical side wall 2. The floor of the bin 1 is formed by a right circular frustoconical hopper 3 having at its bottom an opening 4 surrounded by a bolt ring 6 normally used to attach discharge apparatus to the hopper 3. Typically, the walls of the hopper 3 have a slope which is shallower than that needed for mass flow movement of material through the bin 1 without the use of corrective devices.

The flow control device 7 of the present invention includes an inner cone 9 positioned partially inside the hopper 3 with its vertex extending downward through the opening 4. The inner cone 9 is open at both ends and is sufficiently steep to promote mass flow of material in the hopper 3. The inner cone 9 is supported in its operable position by webs 8 mounted on its outer surface and extending downward to an outer cone 11 below and adjacent to the bolt ring 6. A flanged ring 12 encircling the top of the outer cone 11 is fastened to the bolt ring 6 by bolting, welding, or other well-known means, to secure the device 7 to the hopper 3.

It has been found that if the angle formed between the inner cone 9 and the hopper 3 is less than the angle of repose of the material, which is the angle measured from the horizontal which the material assumes when at rest, then the material in the bin will move in mass flow. This constraint determines the range within which the slope of the inner cone 9 can be chosen.

The diameter of the top of the inner cone 9 is approximately equal to but slightly less than the interior diameter of the bolt ring 6 at the bottom of the hopper 3, so that the device 7 can be inserted therethrough. The top of the inner cone 9 will usually measure five feet across, since the interior diameter of the standard bolt ring 6 on a typical bin is five feet. A pair of cross-bars 13 traverse the top of the inner cone 9 to support it against the compressive force of surrounding material, and a ring 14 surrounds the top of the inner cone 9 for additional structural support.

The inner cone 9 separates the bottom of the hopper 3 into a central channel and a peripheral channel. Below the bolt ring 6, the outer cone 11, which is positioned with its vertex lying on the axis of the hopper 3, supplies the outer wall of the peripheral channel. The webs 8 extending outward from the outer surface of the inner cone 9 further divide the lower portion of the peripheral channel. These webs 8, preferably have a generally triangular shape. Two sides of the triangle are welded to the inner cone 9 and outer cone 11, with the third side forming an exposed edge which extends vertically downward from the top of the inner cone 9 to the bolt ring 6, allowing the inner cone 9 and webs 8 to be inserted through the bolt ring 6, and minimizing the materials used in construction of the device 7.

It has been found that the precision with which the flow can be controlled increases with increasing numbers of separate channels, and that a central channel surrounded by a symmetrical arrangement of peripheral channels is advantageous for avoiding non-symmetrical flow around the center, and other undesirable effects. The use of four webs 8 spaced equidistantly around the inner cone 9, creating a central channel surrounded by four generally equal peripheral channels, has been found to give a satisfactory degree of control in most cases, while being economical to manufacture.

It has been found preferable to have approximately 25% of the material flow through the central channel. Thus, it is desirable for the top of the inner cone 9, which is the inlet for the central channel, to have one-fourth the cross-sectional area of the hopper 3 in the plane defined by the top of the inner cone 9. Thus, while the optimal diameter for the top of the inner cone 9 is determined by the size of the bolt ring 6, the optimal height of the inner cone 9 above the bolt ring 6 is that height which places the top of the inner cone 9 in a horizontal plane which intersects the hopper 3 in a circle having a diameter twice that of the top of the inner cone 9. For example, in a 15- to 20-foot diameter bin 1 having a hopper 3 with a 60° slope and a five-foot diameter bolt ring 6, the inner cone 9 will extend about $4\frac{1}{3}$ feet over the bolt ring 6. This height can, of course, be varied to change the percentage of cross-sectional area of the hopper 3 occupied by the top of the inner cone 9.

Figure 4:
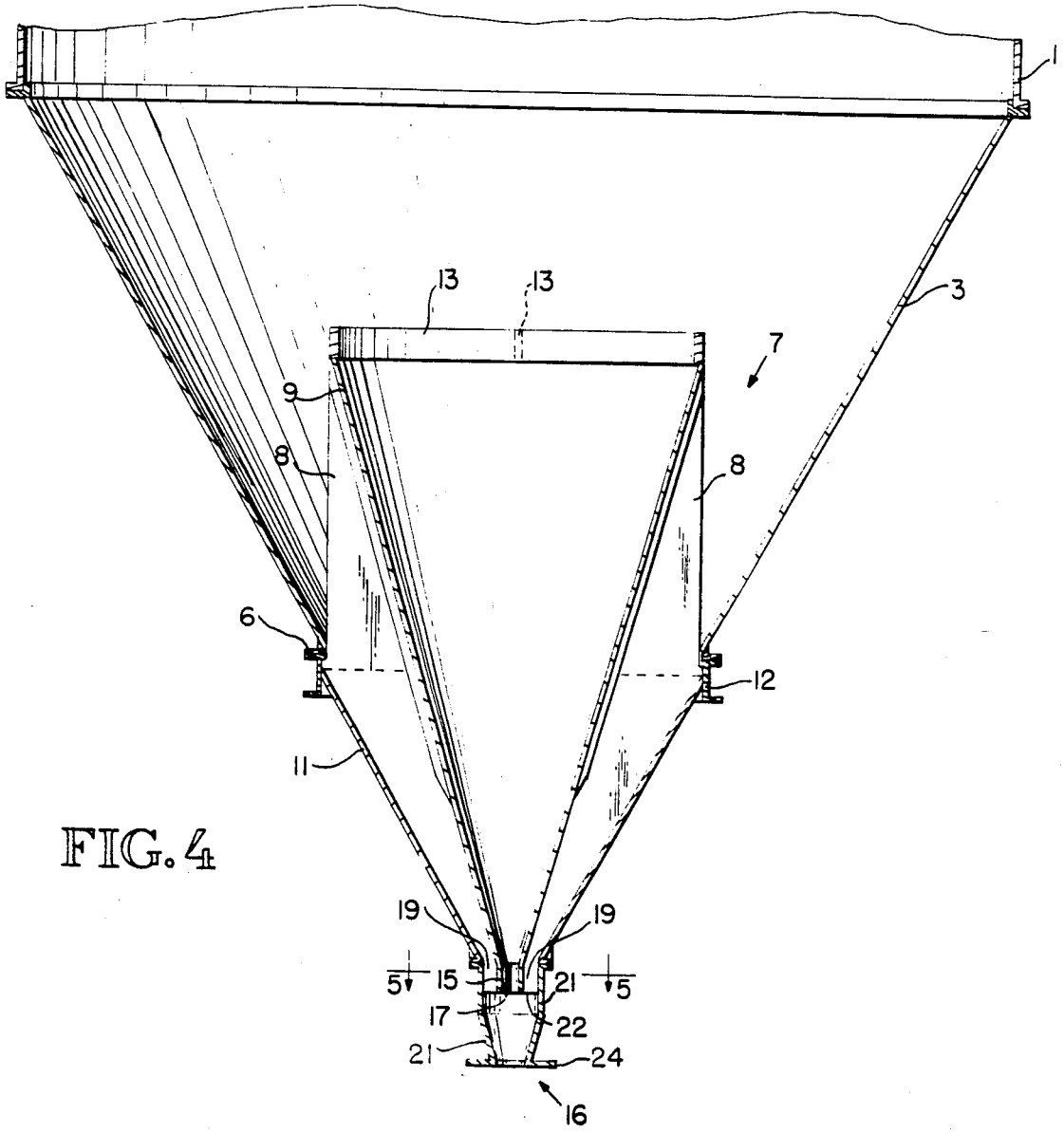
FIG. 4 is a horizontal cross-sectional view of the bin of FIG. 1.
Figure 5:
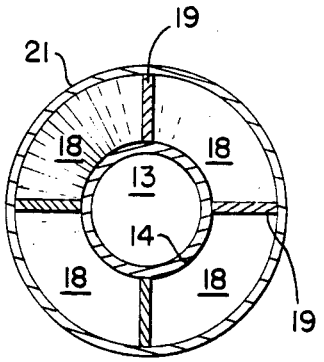
FIG. 5 is a cross-sectional view taken along line 5—5 of FIG. 4.

A blending tube 16 for combining material from the segregated channels into a single stream extends from the bottom of the outer cone 11. As is best shown in FIGS. 4 and 5, the blending tube 16 includes a central compartment 17 formed by a cylindrical extension 15 of the inner cone 9 as the outlet of the central channel. Peripheral compartments 18 surrounding the central compartment 17 are formed by downward extensions 19 of the webs 8 and an outer cylinderical conduit 21 which is bolted to the bottom of the outer cone 11. These peripheral compartments 18 are the outlets through which material in the peripheral channels is withdrawn.

The relative proportions of the cross-sectional areas of the central and peripheral compartments 17, 18 are chosen to provide the desired flow pattern and velocity distribution in the hopper 3. This can be accomplished most easily by movable means to change the ratios of the cross-sectional areas of the compartments 17, 18. As an example of a typical configuration for the compartments 17, 18, the central compartment 17 of the blending tube 16 will have a horizontal cross-sectional area equal to 25% of the cross-sectional area of the outer conduit 21 since it is usually desirable to have 25% of the material flow through the central channel. For convenient selection of the proportion of material flowing through each peripheral compartment 18, each web extension 19 is preferably bendable about a horizontal axis in the plane of the top of the outer conduit 21, which is preferably co-planar with the top of cylindrical extension 15, to adjust the cross-sectional area of the outlets for the peripheral channels formed by the peripheral compartments 18.

The lower edges of the compartments 17, 18 are co-planar and define a blending plane 22 below which the material flows in a single stream. The outer conduit 21 extends downward below this plane for a sufficient distance to give rise to laminar mass flow movement of the material at the blending plane 22. A slightly tapered conical outfeed section 23, with a flange 24 thereon for connection to conventional discharge flow receiving equipment, is connected to the bottom of the outer conduit 21 to provide a restricted outlet for preventing free flow of material. Although laminar mass flow will not occur in this conical section 23, if its taper is sufficiently steep for mass flow to occur therein, the length of outer conduit 21 needed to maintain a laminar mass flow at the blending plane 22 will be minimized.

A unique advantage of the present invention is that it can be specially set up for conditions in a specific bin, or to achieve a specific purpose, either at the point of manufacture or on-site, in an economical manner. The flow pattern of material in the bin 1 can be altered as desired by a proper choice of the ratio of the rates of flow of material through each channel. These rates are determined by the cross-sectional areas of the inlets and outlets of the channels. While the cross-sectional area of the inlets of the channels can be fixed as desired by varying the height or slope of the inner cone 9, a flow control device 7 of standard outer dimensions can be initially adjusted at the place where it is manufactured by altering the dimensions of the compartments 17, 18 of the blending tube 16. In either case, additional adjustments can be made after the device 7 is installed in the bin 1, if necessary.

The following is an example of how the device 7 can be altered to fit a particular situation. Material loaded into a cylindrical bin having an inlet along its central axis will assume a conical configuration, with fine particles tending to accumulate toward the center of the bin and coarser material tending to roll downward toward the bin walls. Thus, fines are located at a higher level than the coarse particles which entered the bin at the same time. If it is desired to discharge material from the bin 1 in the same order in which it entered, the area of the central compartment 17 at the blending plane 22 can be increased to induce a greater flow rate through the center of the adjustment zone above the device 7 so that the originally higher fine material will reach the blending plane 22 at the same time as coarse material which entered the bin 1 at the same time.

Likewise, in a bin having an off-center inlet port and centered outlet, material will settle in the bin in a sloped pile having its highest point under the inlet. The area of the peripheral compartments 18 on the side nearest the inlet can be increased by bending the web extensions 19, to compensate for the slope of the material and allow all material that entered the bin simulateously to exit in like manner.

If mixing is desired, similar adjustments can be made to mix materials from different horizontal regions of a bin. The details of these adjustments, and those discussed above, can be found by empirical means.

Although the invention has been described with reference to a particular embodiment used in a particular environment, it will be understood that modifications can be made within the scope of the invention.

What is claimed is:

1. A device for controlling the flow of a solid material through a bin having a hopper with an opening at its bottom comprising:

first means, extending into the lower portion of the hopper for dividing the lower portion of the hopper into a central channel and a unitary peripheral channel through which the material will move in mass flow, said first dividing means being insertable through said opening;

means forming extensions of said central and peripheral channels below said opening at the bottom of said hopper through which the material will move in mass flow;

second means extending between said first dividing means and said extension forming means for dividing said extension of said peripheral channel into a plurality of segregated portions and supporting said first dividing means;

means for selectively fixing the ratio between the rates at which material flows through said central and peripheral channels and said segregated portions thereof; and means for recombining the material from said extensions of said central and peripheral channels into a single stream.

2. A device according to claim 1 wherein said first dividing means includes a first conical surface positioned in proximity to the bottom of said hopper with its vertex downward, and open at each end for receiving and discharging material therethrough, said first conical surface being sufficiently steep to promote downward movement of material.

3. A device according to claim 2 wherein said means forming extensions of said peripheral channels includes a second conical surface open at each end and positioned below and in proximity to said opening and around said first conical surface to receive material flowing between said first conical surface and the walls of said hopper.

4. A device according to claim 3 wherein said second dividing means includes a plurality of webs mounted on and extending outwardly from said first conical surface to said second conical surface, whereby said webs and second conical surface define a plurality of segregated portions of said peripheral channel around a central channel defined by said first conical surface, the upper and lower edges of said channels defining inlets and outlets, respectively.

5. A device according to claim 4 wherein the flow rate ratio fixing means includes means for fixing the ratio of the cross-sectional areas of the outlets of said segregated portions of said peripheral channel and said central channel.

6. A device according to claim 5 wherein the cross-sectional area ratio fixing means includes a movable extension on the lower edge of each of said webs.

7. A device according to claim 4 wherein said recombining means includes an inner conduit extending downward from said first conical surface, and an outer conduit extending downward from said second conical surface to receive material therefrom and discharge said material in mass flow.

8. A device for controlling the flow of material through a bin having a hopper bottom with an outlet opening, comprising:

an outer conical channel means open at both ends;

an inner conical channel means insertable through said outlet opening, and open at both ends, nested within and spaced from said outer conical channel means and having at least a portion thereof extending above the outer conical channel means;

a plurality of webs extending between said inner conical channel means and said outer conical channel means and insertable through said outlet opening for supporting said inner conical channel means relative to said outer conical channel means; and means for mounting said outer conical channel means to said outlet opening with the vertex of said outer conical channel means extending away from said hopper, whereby said outer conical channel means will receive material flowing between said inner conical channel means and the walls of said hopper.

9. A device according to claim 8 wherein each of said plurality of webs is generally triangular in shape, with one side thereof forming a right angle with the general plane of the top of said inner conical channel means.

10. A device according to claim 8 wherein said plurality of webs are arranged symmetrically around said inner conical channel means.

11. A device for controlling the flow of a solid material through a bin having a hopper with an opening at its lower end and a mounting ring around its lower end comprising:

first means, extending into the lower portion of the hopper for dividing the lower portion of the hopper into a central channel and a unitary peripheral channel through which the material will move in mass flow, said first dividing means being insertable up through said ring;

means forming extensions of said central and peripheral channels below said opening at the lower end of said hopper through which the material will move in mass flow;

second means for dividing said extension of said peripheral channel into a plurality of segregated portions;

means for selectively fixing the ratio between the rates at which material flows through said central and peripheral channels and said segregated portions thereof; and means for recombining the material from said extensions of said central and peripheral channels into a single stream.

12. A device for controlling the flow of a solid material through a bin having a hopper with an opening at its lower end and a mounting ring around its lower end comprising:

first means extending into the lower portion of the hopper for dividing the lower portion of the hopper into a central channel and a unitary peripheral channel through which the material will move in mass flow, said first dividing means including a first conical surface insertable up through said ring and positioned in proximity to the lower end of said hopper with its vertex downward, and open at each end for receiving and discharging material therethrough, said first conical surface being sufficiently steep to promote downward movement of material;

means forming extensions of said central and peripheral channels below said opening at the lower end of said hopper through which the material will move in mass flow, said extension forming means including a second conical surface open at each end and positioned below and in proximity to said opening and around sid first conical surface and mountable to said ring to receive material flowing between said first conical surface and the walls of said hopper;

second means for dividing said extension of said peripheral channel into a plurality of segregated portions, said second dividing means including a plurality of webs mounted on and extending outwardly from said first conical surface to said second conical surface, and insertable up through said ring whereby said webs and second conical surface define a plurality of segregated portions of said peripheral channel around a central channel defined by said first conical surface, the upper and lower edges of said channels defining inlets and outlets, respectively.

13. A device for controlling the flow of a solid material through a bin having a hopper with means forming an opening at its lower end comprising:

a first tapered channel forming means extending into the lower portion of the hopper for dividing the lower portion of the hopper into a central channel and a unitary peripheral channel through which the material will move in mass flow, said first tapered channel forming means being insertable up through said opening and positionable in proximity to the lower end of said hopper for receiving and discharging material therethrough, said first tapered channel forming means being sufficiently steep to promote gravity mass flow of material;

a second tapered channel forming means for forming extensions of said central and peripheral channels below said hopper opening through which the material will move in mass flow, said second tapered channel forming means being open at the top and bottom ends thereof with said top end conforming to said hopper opening and mountable thereto in surrounding relation to said first tapered channel forming means to receive material flowing between said first tapered channel forming means and the walls of said hopper;

means for dividing said extension of said peripheral channel into a plurality of segregated portions, said dividing means including a plurality of webs mounted on and extending outwardly from said first tapered channel forming means to said second tapered channel forming means, and insertable up through said hopper opening, whereby said webs and said second tapered channel forming means define a plurality of segregated portions of said peripheral channel around a central channel defined by said first tapered channel forming means.

14. A particulate material flow control insert for a hopper bottom bin having an outlet opening therein comprising;

first channel forming means dimensioned to pass through said opening with the lower portion thereof extending below said opening, said first channel forming means being configured to form a central mass flow channel in said hopper and to cooperate with the hopper walls to form a separate peripheral mass flow channel about said central channel;

second channel forming means surrounding the lower portion of said first channel forming means in spaced relation therewith to form an extension of said peripheral mass flow channel, said second channel forming means having a top rim conforming to said outlet opening and adapted for connection thereto; and a plurality of generally triangular webs, dimensioned to pass through said opening and connecting said first channel forming means to said second channel forming means for support thereby, each web having one side configured to form a right angle with the general plane of said opening, said plurality of webs comprising means for supporting said first channel forming means and for dividing said peripheral channel into a plurality of separate mass flow channels.

15. A flow control insert according to claim 14 further comprising means for combining material flowing out from said central mass flow channel and said extension of said peripheral mass flow channel into a single stream.

16. A bin bottom insert for creating mass particulate material flow comprising:

first channel forming means having an upper open ended portion for insertion into a bin bottom and a lower portion exterior thereto, the inner surface of said channel being tapered to create mass flow therethrough;

second channel forming means surrounding the lower portion of said first channel forming means in spaced relation thereto so as to form a peripheral mass flow channel therewith;

web means connected between said first and second channel forming means and extending to the upper portion of said first channel forming means to provide support therefor and to maintain said spaced relation, said web means dividing said peripheral channel into a plurality of separate peripheral flow channels having inlet ends and outlet ends; and means on the lower edge of each of said webs for selectively varying the cross-sectional areas of said outlet ends of said peripheral flow channels.

17. A bin bottom insert according to claim 16 wherein said web means comprises the sole support for said first channel forming means.

* * * * *

UNITED STATES PATENT AND TRADEMARK OFFICE

CERTIFICATE OF CORRECTION

PATENT NO. : 4,548,342

DATED : October 22, 1985

INVENTOR(S) : Glen W. Fisher

It is certified that error appears in the above-identified patent and that said Letters Patent is hereby corrected as shown below:

Title page, In the Abstract:

Line 2, "inducted" should read --induced--.

Signed and Sealed this

*Eleventh* Day of *March 1986*

[SEAL]

*Attest:*

DONALD J. QUIGG

*Attesting Officer*

*Commissioner of Patents and Trademarks*